US006363543B1

(12) United States Patent
Bright, Jr.

(10) Patent No.: US 6,363,543 B1
(45) Date of Patent: Apr. 2, 2002

(54) FOOT ACTUATED TOILET SEAT LIFTING, AND RESEATING DEVICE

(76) Inventor: Samuel D Bright, Jr., 1050 Forselles Way, Apt #10, Hayward, CA (US) 94544

( * ) Notice: Subject to any disclaimer, the term of this patent is extended or adjusted under 35 U.S.C. 154(b) by 0 days.

(21) Appl. No.: 09/749,190

(22) Filed: Dec. 26, 2000

(51) Int. Cl.[7] ..... A47K 13/10
(52) U.S. Cl. ..... 4/246.2
(58) Field of Search ..... 4/246.1–246.5

(56) References Cited

U.S. PATENT DOCUMENTS 2,723,400 A * 11/1955 Wilson ..... 4/246.1
4,951,323 A * 8/1990 Shalom ..... 4/246.1
5,103,506 A * 4/1992 Munford et al. ..... 4/246.4

FOREIGN PATENT DOCUMENTS

WO 9006715 * 6/1990 ..... 4/246.2

* cited by examiner

*Primary Examiner*—Charles E. Phillips

(57) ABSTRACT

A unit that is used to lift a toilet seat. This unit has a base hinge with a foot pedal that uses a cable and pulley lifting system. This system lifts a movable rod of a shock-absorber device, which in turn lifts a seat bracket and the toilet seat. A removable adjustment pad, limits the travel lift distance of the toilet seat. This adjustment keeps the toilet seat on a slight tilted angle. The gravity of the seat on an angle, returns the seat when a pedal is depressed.

The shock absorber device slows the returning decent of the seat back down to the bowl when the pedal is depressed. The shock absorber device resides inside a housing tube, and it rests on top of a bottom cover plate pedestal. The housing tube is attached to a base hinge. There is non-skid material on the bottom cover plate to stabilize the unit while in use.

2 Claims, 7 Drawing Sheets

Fig.9-a
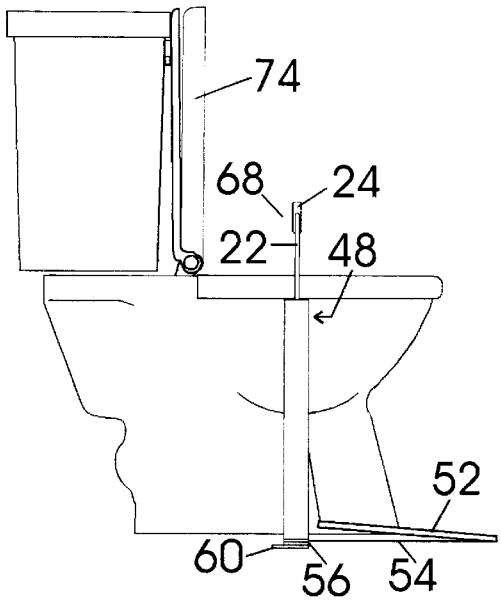
Fig.9-b
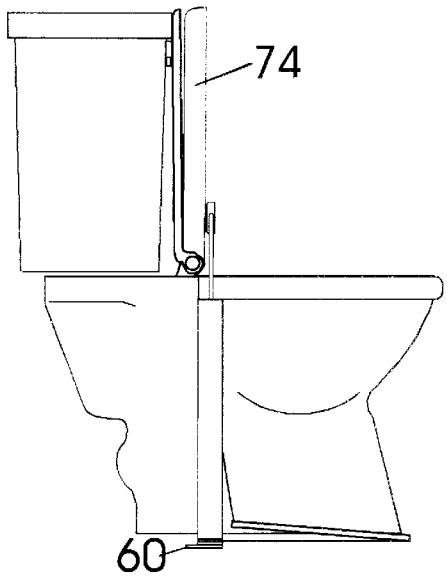
Fig.9-c
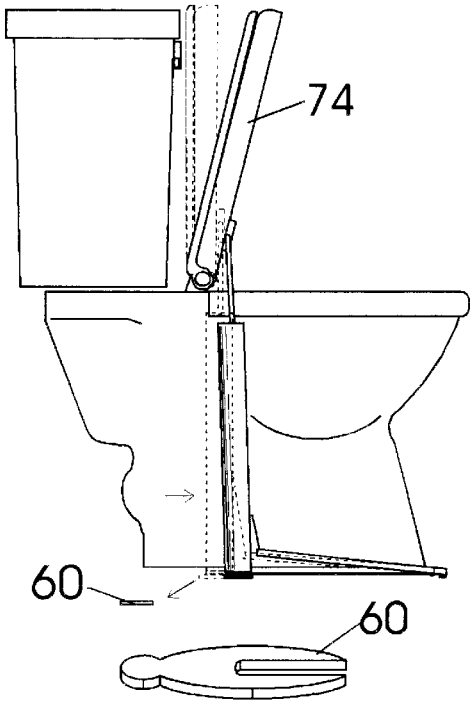

FOOT ACTUATED TOILET SEAT LIFTING, AND RESEATING DEVICE

BACKGROUND FIELD OF INVENTION

This invention relates to the field of toilet seat-lifters, and more specifically, to toilet seat lifters operated by application of pressure by the user's foot. Many prior art foot actuated toilet seat-lifting devices are known, employing levers, rods, cables, air and fluid displacing pistons. The force of the user's foot is transmitted to the toilet seat, so that the seat is lifted. By not touching the seat with the hand, the risk of spreading microorganism that can cause sickness and disease transmission is greatly reduced. Furthermore the inconvenience of bending over is eliminated. None of the prior devices have achieved wide acceptance and use. This lack of acceptance and use is believed to be due, at least in part to a few disadvantages inherent in the design of prior art devices. One of the major disadvantages is most of the prior art devices have not managed to hide the mechanical hardware (levers, rods, air and fluid displacing pistons linkage, etc.). They appear as a crude mechanical hardware device instead of a bathroom accessory. This is not acceptable to the public.

Another disadvantage is the mechanical complexity that makes them too expensive, and requires complicated installation procedures that are unacceptable to customers. Devices such as that disclosed in, U.S. Pat. No. 4,030,146 of Pilkington and U.S. Pat. No. 4,649,576 of Lillie are functional, but are not visually appealing, and only slightly inhibit the force associated with the lowering of the seat. If the user's foot is suddenly removed from the mechanism, there is nothing in place to prevent the seat from slamming back down. U.S. Pat. No. 3,055,016 of Kemp uses multiple levers and foot pedals, complex linkages, does not provide for adjustment of the air cylinder to different height toilets, and is very difficult to install. U. S. Pat. No. 3,504,385 of Fields positions a cylinder vertically behind the lifting arm, which seriously limits its anti slamming protection capability. The prior art devices make no provision for user comfort such as if the user is barefoot when using the facility in the middle of the night. Devices such as U.S. Pat. No. 4,975,988 of Won, and U.S. Pat. No. 4,426,743 and U.S. Pat. No. 4,470,161 of Seabrooke, are so technical that they would require extremely detailed installation instructions which the average person would find too burdensome. In addition, the cost to manufacture and thus retail price of the product would be commercially unfeasible. U.S. Pat. No. 5,237,708 of Zamoyski describes a very functional but cumbersome mechanical hardware device. A very basic, low-cost accessory is required which is easy to install and easy to use as it gently lifts up and then lowers the toilet seat back down without slamming despite varying degrees and swiftness of pressure and release of the foot pedal by various users. This appliance needs to look like a bathroom accessory or fixture, and thus blend into the interior.

ADVANTAGES OF THE INVENTION

The preferred embodiment of this invention provides an inexpensive, easy to use, easy to install, toilet seat lifter. The design has the look of a bathroom accessory, while performing the lifting of the toilet seat. The unit then allows the toilet seat to naturally fall back down, slowing the rate of fall to the bowl.

Another preferred embodiment of the invention eliminates the need to bend over to lift the seat (this saves the back) and protects the user's hand from contracting diseases from the toilet seat.

Another preferred embodiment of the invention offers a low manufacturing cost, and installs in less than 2 minutes onto a wide variety of toilet seats. No tools are required to do the installation, and the device is easily displaced for floor cleaning.

SUMMARY OF THE INVENTION

A device that is used to lift a toilet seat. This device has a base hinge with a foot pedal that uses a cable and pulley lifting system. This system lifts the movable rod of a shock absorber device, which in turn lifts the seat bracket and the toilet seat. The removable adjustment pad, limits the travel lift distance of the toilet seat. This adjustment keeps the toilet seat on a slight tilted angle. The gravity of the seat on an angle, returns the seat when pedal is depressed.

The shock absorber device slows the returning decent of the seat back down to the bowl when the pedal is depressed. The shock absorber device resides inside the housing tube, and it rests on top of the bottom cover plate pedestal. The housing tube is attached to the base hinge. There is non-skid material on the bottom cover plate.

Theory of application

As pressure from the user's foot is applied to the foot pedal, the rod of a shock absorber device extends upward lifting the bracket and the attached toilet seat. The seat is lifted to about an 85 degree angle. This action also extends out the piston of the shock absorber device and air fills the shock absorber. At the exhaust end of the shock absorber there is a one-way valve with a partially blocked outlet.

When the pedal is released, the toilet seat starts to descend by gravity and angle of the seat. The seat moves downward and the shock absorber starts to compress air in the cylinder and the valve at the bottom of the shock absorber allows the air to escape slowly providing a controlled, gentle return of the seat to the bowl.

DESCRIPTION OF DRAWINGS

FIG. 5-*a* is an enlarged view of the low profile hinge pin embedded in the bottom side of foot pedal.

FIG. 5-*b* is a see-through isometric view of the bottom portion of foot operated seat lifting device.

FIG. 5-*c* is an enlarged side view of the hinge strap inserted into the embedded hinge pin in the bottom of the foot-pedal.

FIGS. 9-*a*, 9-*b*, and 9-*c* is a view of the installation process of foot operated seat lifting device.

Reference Numbers In Drawings

Figure 1:
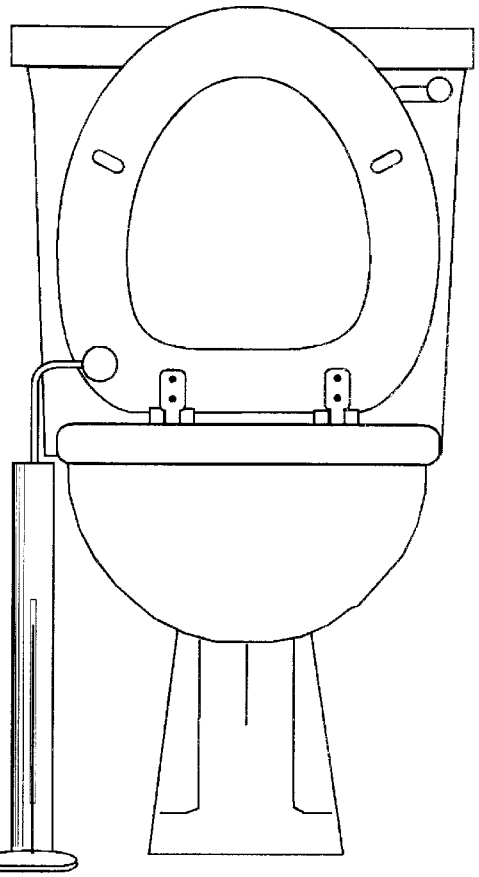
FIG. 1 is a front view of the toilet and the foot operated seat lifting device attached to the toilet seat.
Figure 2:
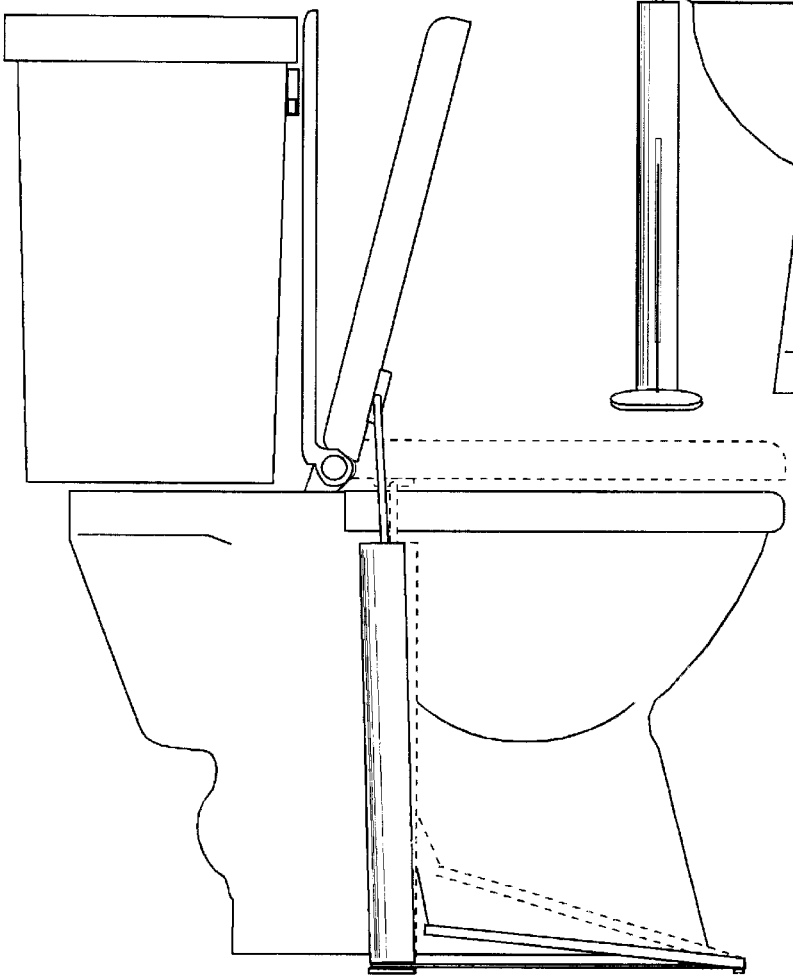
FIG. 2 is a side view of the foot operated seat lifting device with simulated operation.
Figure 3:
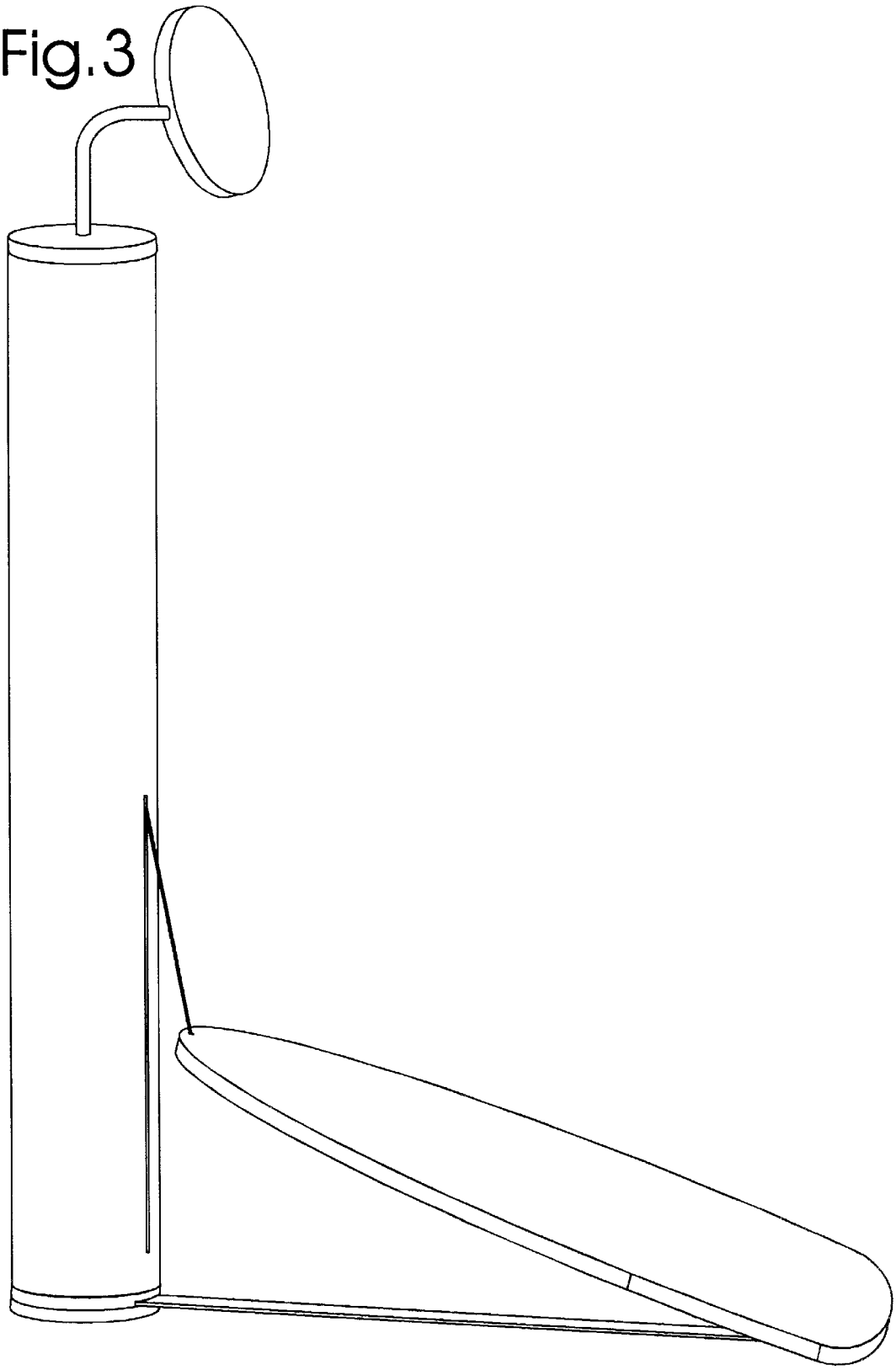
FIG. 3 is an enlarged side view of the foot operated seat lifting device.

20 support cap
22-*a* pulley support slot
22-*b* pin socket
22 piston rod
24 seat bracket
26 rubber pad
28 cable brace
30 piston plunger
32 O-ring
34 cable
36-*a* cable clamp
36-*b* cable clamp
38 pulley wheel
40 pulley support pin
42 pneumatic cylinder
44 one way air valve
46 screw-in air plug
48 support housing tube
48-*a* slot
50 bottom support plate
50-*a* pedestal
50-*b* tapered wall
50-*c* socket
52 foot pedal
52-*a* cable eye
52-*b* low profile cutout
54 pedal strap
54-*a* plug
54-*b* hinge
56 non-skid material (for tube)
58 double-sided tape (light duty)
60 angle adjustment pad
62 embedded hinge pin
64 non-skid material (for foot pedal)
68 double-sided tape (heavy duty)
70 double sided tape (protective cover)

DETAILED STATIC DESCRIPTION OF INVENTION

Figure 4:
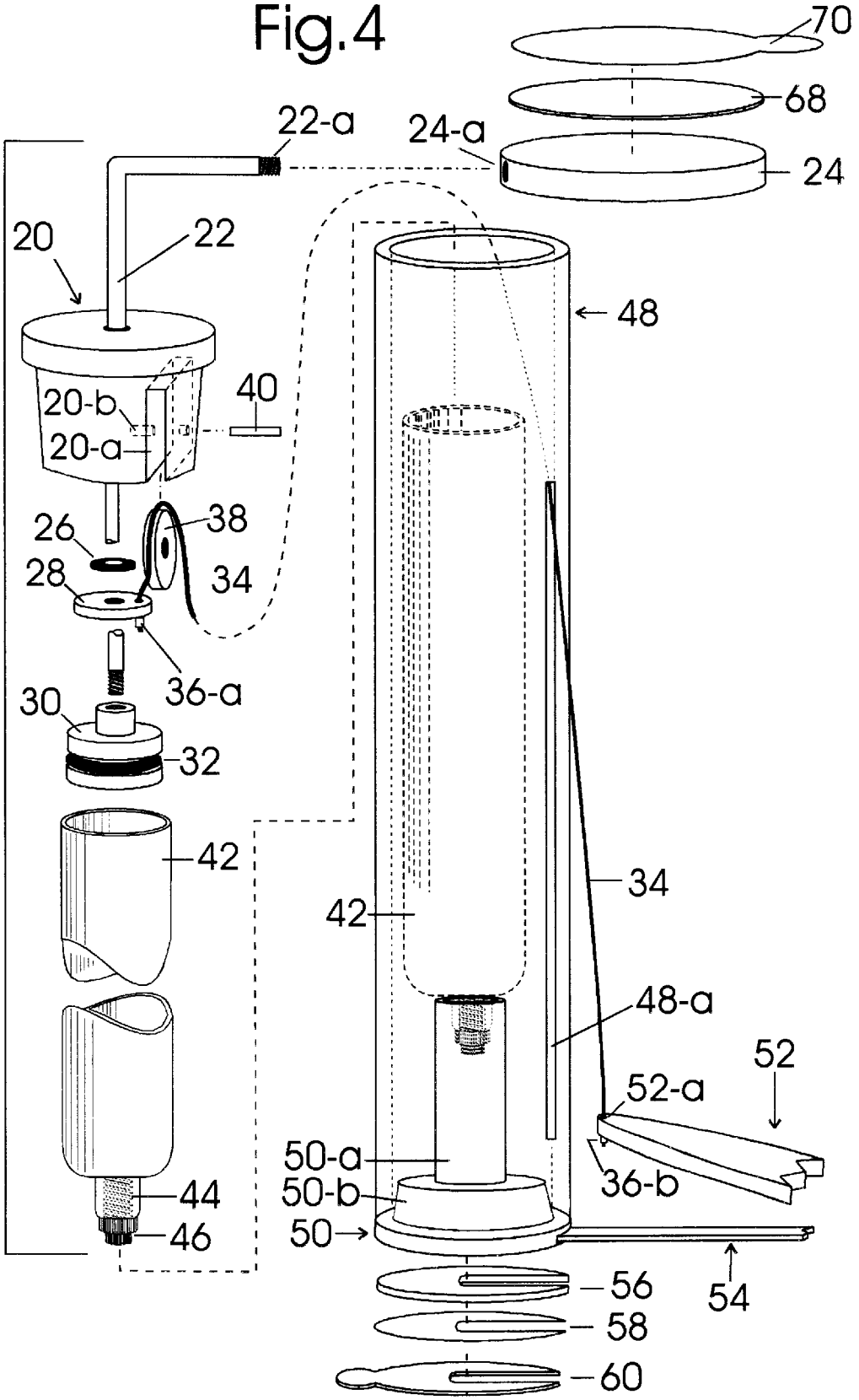
FIG. 4 is an enlarged exploded assembly side view of the foot operated seat lifting device.

FIG. 4 Shows the internal workings of the foot operated toilet seat lifter. The foot operated seat lifter consists of the following: double-sided tape protective cover 70 is removed from double-sided tape 68 to attach the seat bracket 24 to the toilet seat. The seat bracket 24 is connected to rod 22. The other end of rod 22 passes through top opening in support cap 20. The piston rod 22 is then passed through the rubber pad 26 or any other sound damping material. The piston rod 22 is then threaded into the cable brace 28. A piston plunger 30 is threaded onto the same threaded end of the piston rod 22. An O-ring 32 is placed in the groove of piston plunger 30.

Figure 5:
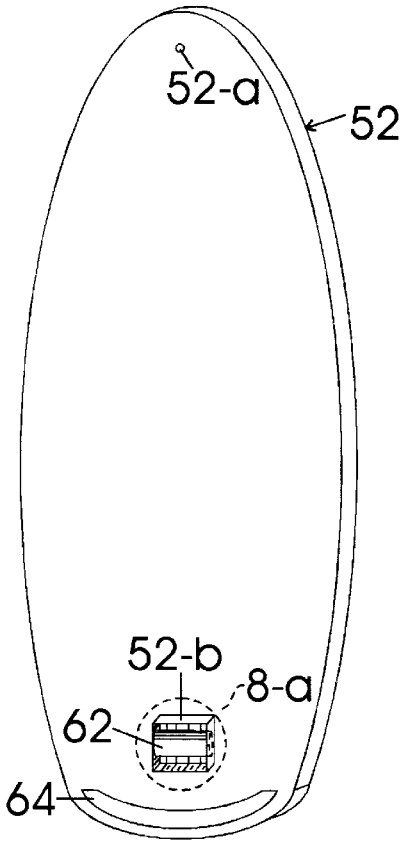
FIG. 5 is an isometric view of the bottom side of foot pedal.
Figure 5:
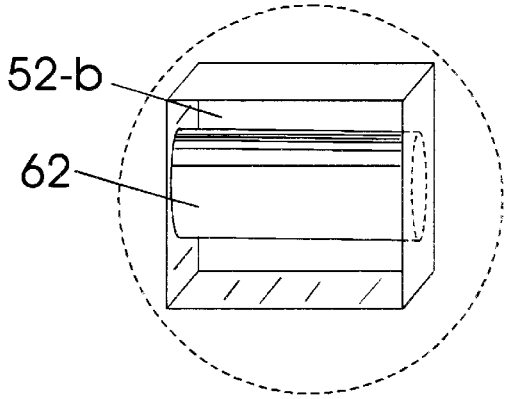
Figure 5:
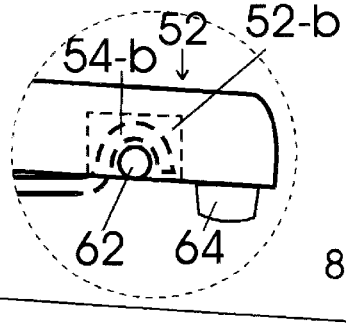
Figure 5:
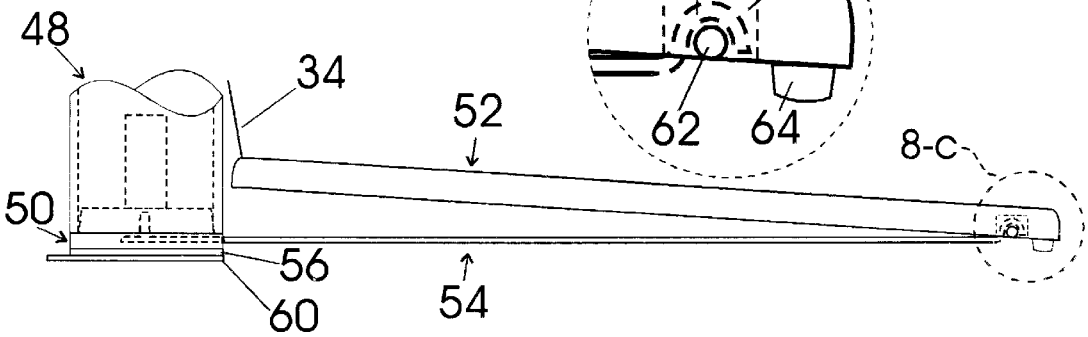
Figure 6:
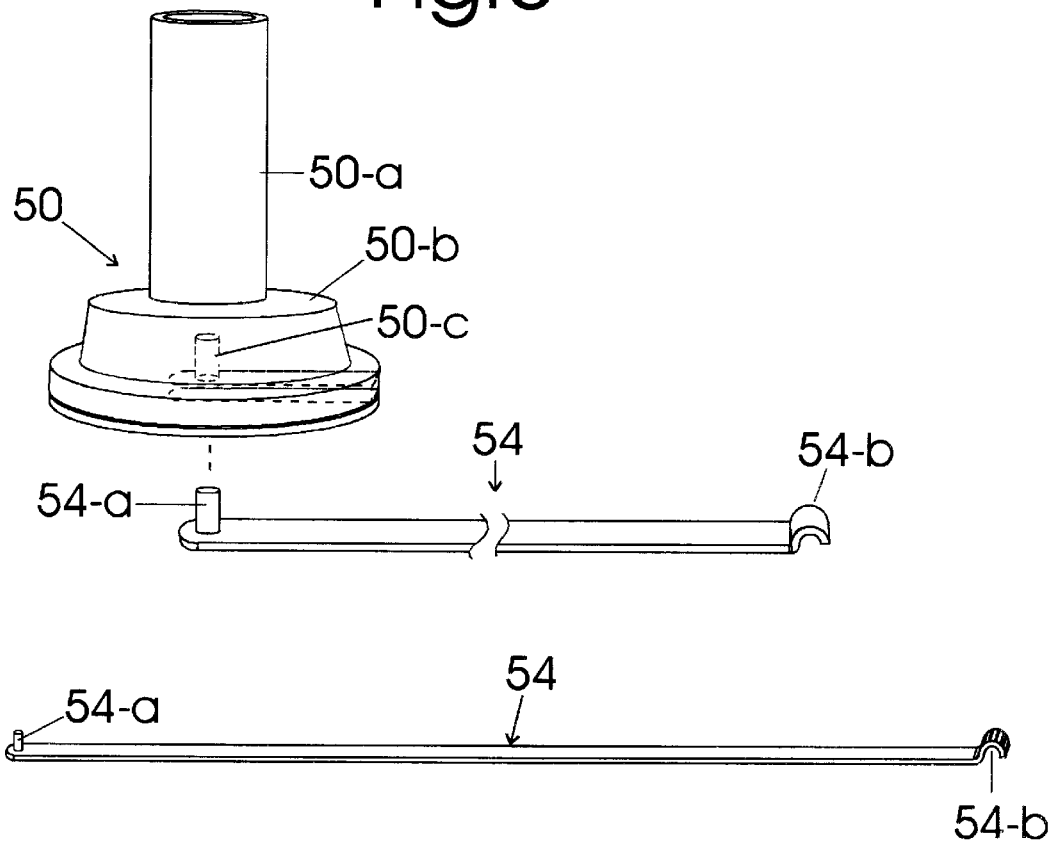
FIG. 6 is a exploded assembly isometric view of the bottom plate cover.
Figure 7:
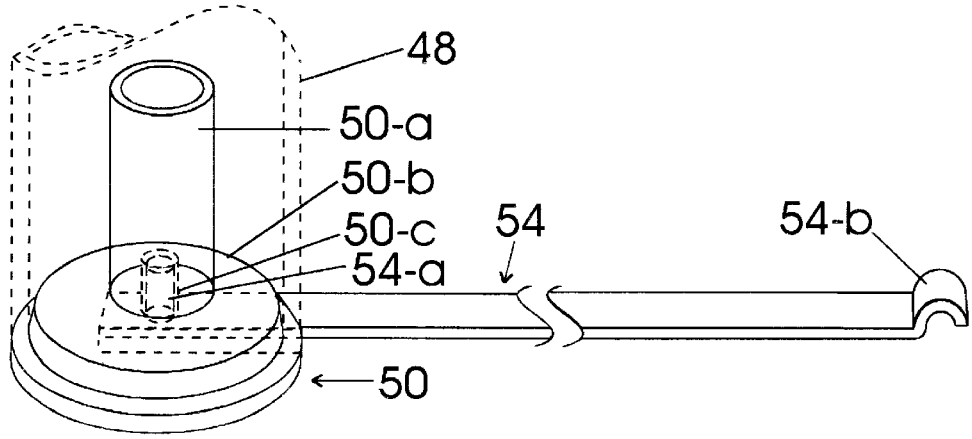
FIG. 7 is an exploded assembly isometric view of the bottom plate cover with the pedal strap inserted.
Figure 8:
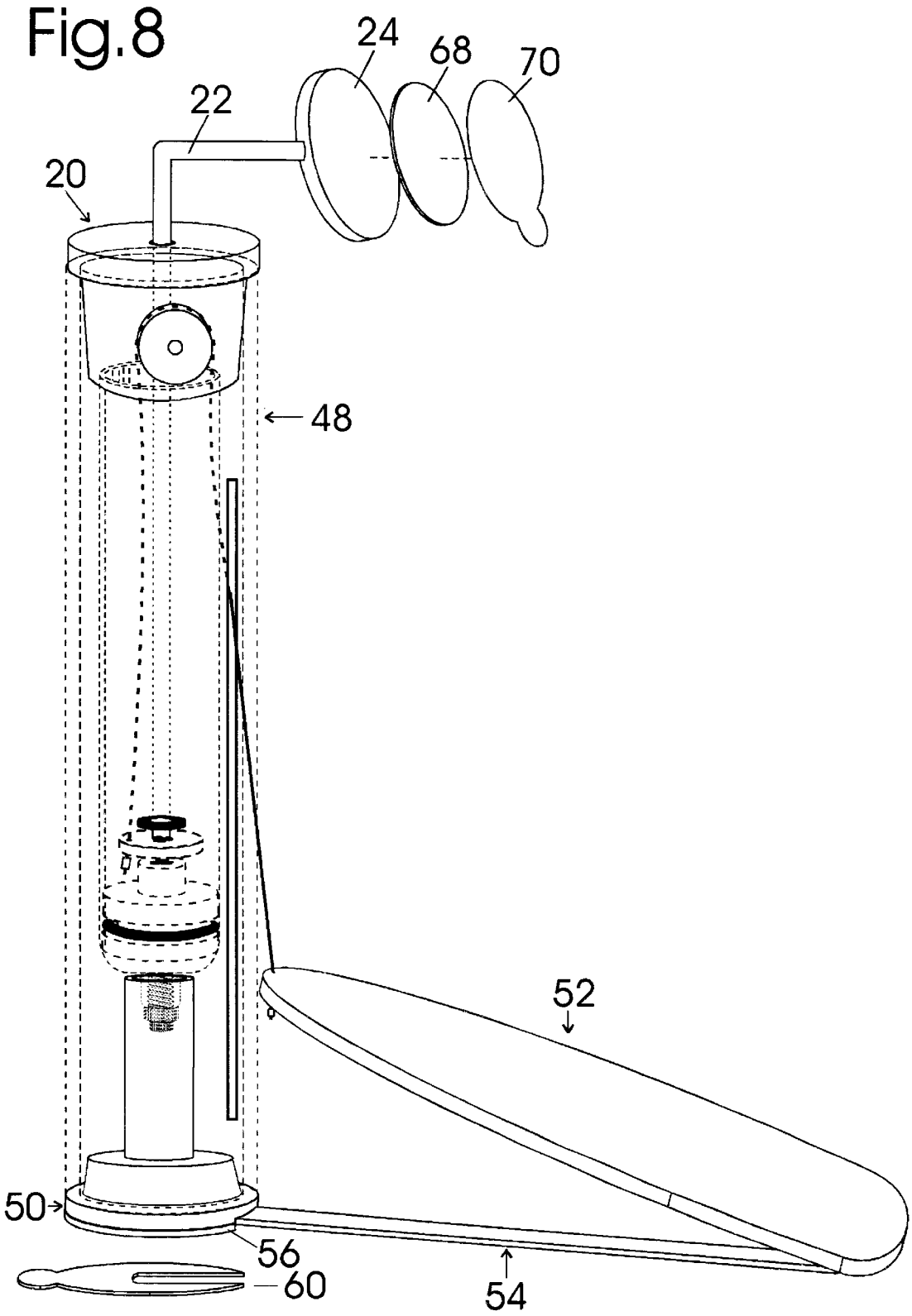
FIG. 8 is a see-through isometric view of the foot operated seat lifting device.

The O-ring 32 can be made of rubber or any other suitable material used for compression. One end of a cable 34 is feed through the cable brace 28 and is secured with cable clamp 36-*a* or by any other means of attaching the cable to a brace. The cable brace 28, piston rod 22, and the piston plunger 30 can be made of molded plastic, metal, or any other suitable material. A pulley wheel 38 is inserted into the slot 20-*a* of the bottom of the support cap 20. A pulley support pin 40 is inserted into pin socket 20-*b* to secured the pulley. The other end of cable 34 is feed over the top of pulley wheel 38 and through pulley support slot 20-*a* of the support cap 20. The piston rod 22, piston plunger 30 with the O-ring 32 is inserted into the pneumatic cylinder 42. A one way air valve 44 is inserted or molded into the compression end of the pneumatic cylinder 42. A screw-in air plug 46 is inserted into the thread of air one way valve 44. The parts on the piston rod 22 inserted inside of the pneumatic cylinder 42 makeup the shock absorber sub assembly. The shock absorber sub assembly is inserted into the housing tube 48. The same end of cable 34 is then feed inside of and through the slot 48-*a* in the housing tube 48. The cable 34 is connected through the eye 52-*a* of the foot pedal 52 by a cable clamp 36-*b* or any other suitable means of attaching a cable to a pedal. The bottom end of the shock absorber sub assembly rests on the pedestal 50-*a* of the bottom support plate 50. The support cap 20 is pressed onto and into the top of housing tube 48. Non skid material 56 is attached to the bottom of the support plate 50 with heavy duty adhesive (not shown). Light duty adhesive 58 keeps adjustment pad 60 attached to nonskid pad 56 until unit installation procedure. The hinge 54-*b* of pedal strap 54 is inserted into low profile cutout 52-*b* and hung on embedded hinge pin 62 in (FIG. 5-*c*). A nonskid pad 64 is attached to the bottom side of foot pedal 52. in FIG, 5-*c*. The plug 54-*a* of pedal strap 54 is then inserted into socket 50-*c* of bottom cover plate 50 in FIG. 6. Most of the parts can be made of ABS, PVC, mold injected plastic, or any other suitable material.

DETAILED OPERATIONAL DESCRIPTION OF INVENTION

The various elements of the system interact as follows to provide a smooth lift, keeps the right angle for seat return, and gently returns the toilet seat back to the down position on the toilet bowl. As pressure from the user's foot is applied to the foot pedal 52, the force pulls cable 34. The cable 34 is hoisted over pulley 38 and is connected to cable brace 28. Cable brace 28 is attached to rod 22. The rod 22 is attached to the seat bracket 24. The seat bracket 24 is affixed to the toilet seat by double-sided tape 68. The force applied to the foot pedal 52 is transferred to cable 34 and to the rod 22 causing the attached seat bracket 24 to lift the toilet seat. During the lifting process, the piston plunger 30 on rod 22 expands outward filling the pneumatic cylinder 42 with air. The seat lifting angle and travel distance is kept constant by way of the installation procedure in FIG, 9-*a*, 9-*b*, and 9-*c*. Install procedures:

In FIG, 9-*a* The foot pedal 52 is depressed down extending up the rod 22 with seat bracket 24. With the toilet seat in the up position, remove the double-sided tape protective cover 70. Make sure that the seat under surface is clean and dry. With the unit resting on the floor and the foot pedal 52 still fully depressed, attach the seat bracket 24 to the toilet seat with double-sided tape 68. as shown in FIG. 9-*b* Remove the adjustment pad 60 and slide the base of the support housing tube 60 forward about an inch. The toilet seat angle will get adjusted to the angle shown in FIG. 9-*c*. , the installation is done. The removal of the adjustment pad 60 subtracts about 10 to 15 degrees from the original upright position. This insures that the toilet seat travel distance and the angle is maintained the same every time the foot pedal 52 is depressed. When the foot pedal 52 is disengaged the angle and weight of the toilet seat causes the seat to fall. This action compresses the air that was previously taken into pneumatic cylinder 42. The air slowly bleeds out of the one way valve 44 and passes by the screw-in air plug 46. The toilet seat rides a cushion of air gently down to the bowl.

CONCLUSION, RAMIFICATIONS AND SCOPE OF INVENTION

The foot actuated toilet seat lift and return performs the following: Smoothly lifts the toilet seat up and slows the natural fall rate of the toilet seat as it returns to the toilet bowl.

The foot pedal 52 of invention has a embedded hinge that gives it a low profile which makes it very comfortable for user even when barefooted. This invention has the hardware concealed in a slender tube, allowing the design to blend inconspicuously into any bathroom seamlessly.

Protects the user's hand from contracting diseases from the toilet seat

The installation takes less than 2 minutes (including reading the instruction and taking it out of the box).

No tools required

Simple and easy to use

The seat is always returned to down position

Eliminates bending over and saves the back

Allows easy access to floor cleaning

Inexpensive to manufacture

Affordable for end user

Reliable under harsh chemical/water environment

Easy to retrofit most household and commercial toilets

A durable design that allows for abuse

Comfortable pedal design

Damping on lowering to avoid slamming of seat

Travel stop on raising the seat to maintain fall angle

The foot actuated toilet seat lift and return is lightweight, and very sturdy. It can be economically constructed from ABS, PVC, or any other suitable material. Many other variations and applications are possible.

What is claimed is:

1. A foot operated mechanism for raising a toilet seat away from a toilet bowl and lowering it back down while retarding the natural falling rate of the seat comprising:

a) a first non skid pad having a foot pedal attached to an upper surface of said non skid pad; a pedal strap attached to the bottom side of one end of said foot pedal, the other end of said pedal strap attached to a bottom support plate, in order to be consistent with the disclosure terminology; a second non skid pad attached to the under side of said bottom support plate, in order to be consistent with the disclosure terminology; an adjustment pad attached to the bottom of said second non skid pad; the bottom support plate, in order to be consistent with the disclosure terminology; attached to a support housing tube; the support housing tube has at the top a top support cap;

b) a shock absorber device resting on top of said bottom support plate, in order to be consistent with the disclosure terminology; and inside of said support housing tube; a piston rod, extending upward from said shock absorber device and through an opening in said top support cap;

a cable with a first end attached to the other end of said foot pedal, the second end of said cable extends into a slot in said support housing tube and riding up and over a pulley mounted in said top support cap at the top of said support housing tube; said cable attached to a cable brace near the bottom end of said piston rod of the shock absorber device; and c) a seat bracket attached to the top end of the movable rod of the shock absorber device and attachable to a toilet seat.

2. Device as in claim 1 wherein said shock absorber device is activated by pressing down of said foot pedal which pulls said cable, hoisting up said piston rod of said shock absorber device, lifting said seat bracket, which when attached to said toilet seat causes said toilet seat to lift up away from said toilet bowl;

wherein, and said adjustment pad is removable, and after installation establishes a fall angle and up travel distance, this action limits the extension of said piston rod and sets the seat return angle when said foot pedal is released, whereby said toilet seat may fall back down by it's own weight from the fall angle and is slowed by the resistance of said shock absorber providing a gentle return of said toilet seat back down to said toilet bowl.

* * * * *

UNITED STATES PATENT AND TRADEMARK OFFICE

CERTIFICATE OF CORRECTION

PATENT NO. : 6,363,543 B1
DATED : April 2, 2002
INVENTOR(S) : Bright, Jr.

It is certified that error appears in the above-identified patent and that said Letters Patent is hereby corrected as shown below:

Title page,
Item [*] Notice, delete the phrase “by 0 days” and insert -- by 43 days --

Signed and Sealed this

Twenty-eighth Day of September, 2004

JON W. DUDAS
*Director of the United States Patent and Trademark Office*